US007735959B2

(12) United States Patent
Takagi

(10) Patent No.: US 7,735,959 B2
(45) Date of Patent: Jun. 15, 2010

(54) INK-JET RECORDING APPARATUS

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 752 days.

(21) Appl. No.: 11/557,877

(22) Filed: Nov. 8, 2006

(65) Prior Publication Data

US 2007/0103505 A1 May 10, 2007

(30) Foreign Application Priority Data

Nov. 8, 2005 (JP) ..... 2005-323319

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 2002/0105560 | A1 | 8/2002 | Shimizu et al. | |
| 2003/0218652 | A1* | 11/2003 | Nakashima | 347/31 |
| 2005/0231548 | A1 | 10/2005 | Tsukada | |
| 2005/0243129 | A1* | 11/2005 | Kim | 347/45 |

FOREIGN PATENT DOCUMENTS

| | | | |
|---|---|---|---|
| EP | 0589604 | A2 | 3/1994 |
| EP | 589604 | A2 * | 3/1994 |
| EP | 0867296 | A2 | 9/1998 |
| JP | 2002370369 | A | 12/2002 |
| JP | 200474774 | A | 3/2004 |

OTHER PUBLICATIONS

European Search Report received in corresponding EP Application No. 06023051.

* cited by examiner

*Primary Examiner*—Stephen D Meier
*Assistant Examiner*—Alexander C Witkowski
(74) *Attorney, Agent, or Firm*—Baker Botts L.L.P.

(57) ABSTRACT

An ink-jet recording apparatus comprises an ink-jet head, a wiper, a drive mechanism, and a wiping controller. The wiper wipes off ink adhering to an ink ejection face on which nozzle openings are formed. The wiping controller controls the drive mechanism so that the wiper, while kept in contact with the ink ejection face, moves relative to the ink-jet head in a wiping direction which is oriented from one end to the other end of the ink ejection face, and also so that the wiper becomes spaced apart from the ink ejection face at a point between a nozzle opening nearest to the other end and a changing position. The changing position is a position at which ink adhesivity changes to become larger along the wiping direction and provided between the other end and the nozzle opening nearest to the other end.

19 Claims, 10 Drawing Sheets

INK-JET RECORDING APPARATUS

BACKGROUND OF THE INVENTION

1. Field of the Invention

The present invention relates to an ink-jet recording apparatus that ejects ink to a recording medium.

2. Description of Related Art

Known is an ink-jet recording apparatus including a head that has many nozzles for ejecting ink and a wiper that wipes off ink adhering to an ink ejection face of the head which means a face of the head in which nozzle openings are formed (see FIG. 10 of Japanese Patent Unexamined Publication No. 2004-74774). A wiper made of an elastic material is, while kept in contact with the ink ejection face of the head, moved relative to the head, that is, a wiping is performed, to thereby remove extra ink adhering to the nozzle openings and therearound, so that ink meniscuses which appear around the nozzle openings can be regulated into a proper condition.

In the apparatus disclosed in this document, an inclined plate is mounted on a carriage that carries the head, and the wiper is, after its front end passes the ink ejection face of the head, temporarily stopped while being in pressure-contact with the inclined plate. Then, the wiper is slightly moved in a direction perpendicular to a direction of its movement in a wiping operation, and performs a wiping operation again. Without the inclined plate, ink scatters around at the time when the front end of the wiper, which is bent during the wiping operation, passes an end of the ink ejection face of the head, because the front end restores its original state due to resilience. In the apparatus disclosed in this document, such an accident can be prevented because the inclined plate is provided.

SUMMARY OF THE INVENTION

In the apparatus disclosed in this document, however, ink can easily enter a gap between the inclined plate and the head. The ink that has entered the gap may naturally fall down due to gravity, or may scatter when a user detaches the head from the carriage for the purpose of treating a jamming of a recording medium. Thus, inside of the apparatus may be polluted with the ink.

A possible measure to be taken is to fill the gap with a seal material. However, filling a seal material makes it difficult to replace the head, and moreover causes increase in cost because an ink-resistant seal material must be used.

In general, the ink ejection face of the head is given a water-repellent treatment. However, in a case where a water-repellent treatment is not given to an end of the head because of a cost problem, etc., ink may remain on the ink ejection face without being carried on the wiper if the wiper becomes spaced apart from the ink ejection face in a non-water-repellent region to which the water-repellent treatment is not given. The remaining ink naturally falls down afterwards and inside of the apparatus may disadvantageously be polluted with ink in the same manner as described above.

An object of the present invention is to provide an ink-jet recording apparatus that can relieve a problem that inside of an apparatus is polluted with ink as a result of a wiping operation.

In an aspect of the present invention, there is provided an ink-jet recording apparatus comprising an ink-jet head, a wiper, a drive mechanism, and a wiping controller. The ink-jet head has an ink ejection face on which a plurality of nozzle openings that eject ink are formed. The wiper wipes off ink adhering to the ink ejection face. The drive mechanism drives at least either one of the ink-jet head and the wiper. The wiping controller controls the drive mechanism so that the wiper, while kept in contact with the ink ejection face, moves relative to the ink-jet head in a wiping direction which is oriented from one end to the other end of the ink ejection face, and also so that the wiper becomes spaced apart from the ink ejection face at a point between a nozzle opening nearest to the other end and a changing position. The changing position is a position at which ink adhesivity changes to become larger along the wiping direction and provided between the other end and the nozzle opening nearest to the other end.

In this aspect, the wiper wipes off all the nozzle openings formed in the ink ejection face, and then becomes spaced apart from the ink ejection face before it reaches the changing position at which ink adhesivity changes to become larger. This can prevent ink from reaching the changing position and thus remaining on the head. Therefore, a problem that inside of the apparatus is polluted with ink as a result of a wiping operation can be relieved.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
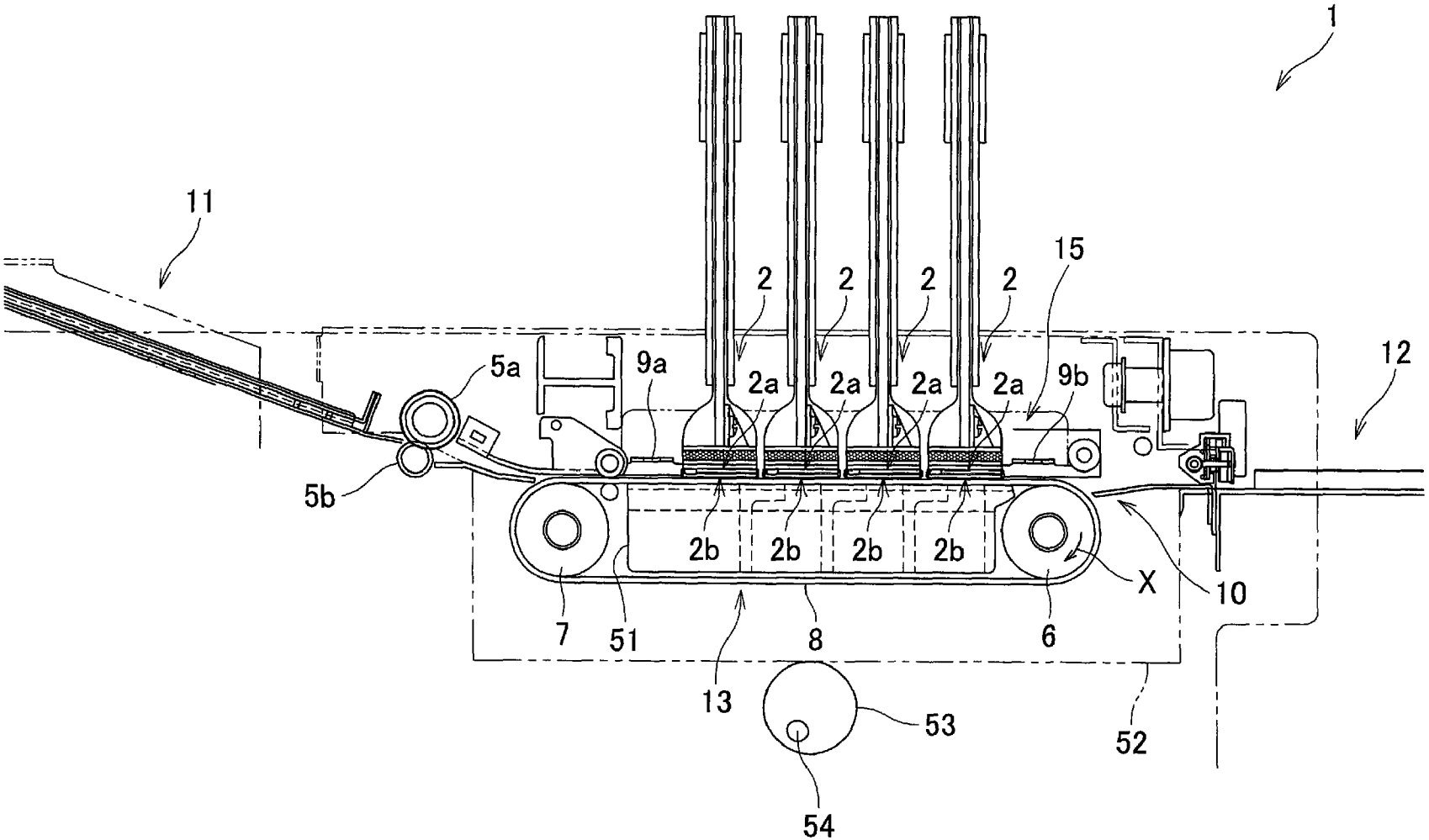
FIG. 1 is a front view of an ink-jet printer according to an embodiment of the present invention.

In the following, a preferred embodiment of the present invention will be described with reference to the accompanying drawings.

First, a general construction of an ink-jet printer according to an embodiment of the present invention will be described with reference to FIGS. 1, 2, 3, and 4. An ink-jet printer 1 of this embodiment is a color ink-jet printer of line type having four ink-jet heads 2.

Each of the heads 2 has, at its lower end, a head main body 2*a* which will be detailed later. The four heads 2 are arranged side by side along a paper conveyance direction with their head main bodies 2*a* being adjacent to each other. The head main body 2*a* has a rectangular plane (see FIG. 2) that is elongated in a direction perpendicularly crossing the drawing sheet of FIG. 1, that is, in a direction perpendicular to the paper conveyance direction. A length of the head main body 2*a* is longer than a width of a paper as a recording medium. A lower face of the head main body 2*a* serves as an ink ejection face 2*b* in which many nozzle openings 28 (see FIG. 3) that eject ink are formed. Magenta ink, yellow ink, cyan ink, and black ink are ejected respectively from the ink ejection faces 2*b* of the four head main bodies 2*a*. The ink ejection face 2*b* is given a water-repellent treatment over its whole area.

Figure 2:
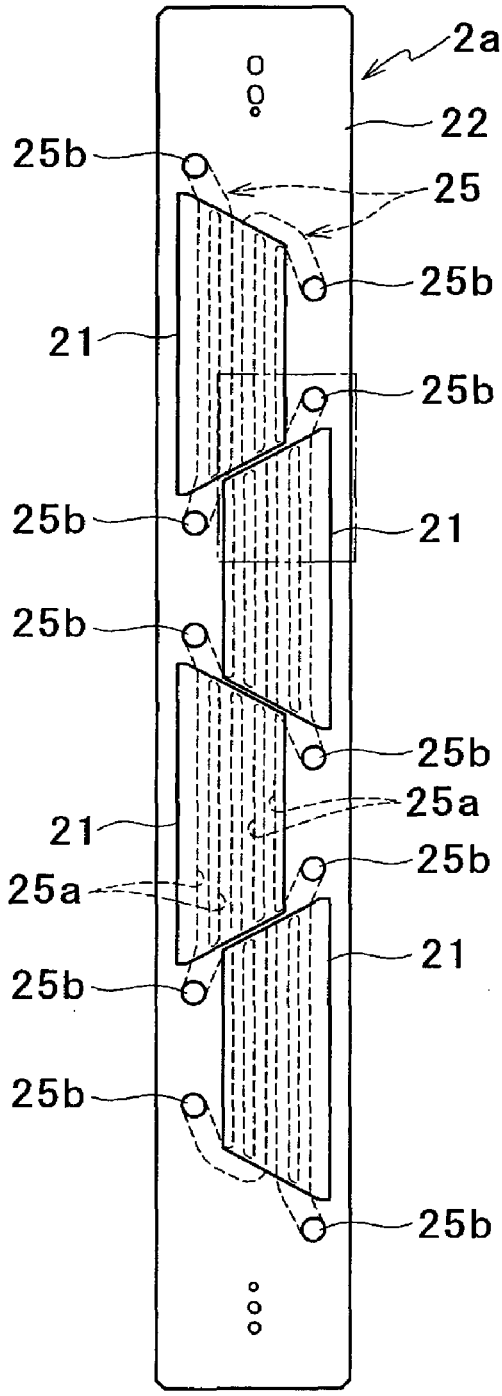
FIG. 2 is a plan view of one of four ink-jet heads that are illustrated in FIG. 1.
Figure 3:
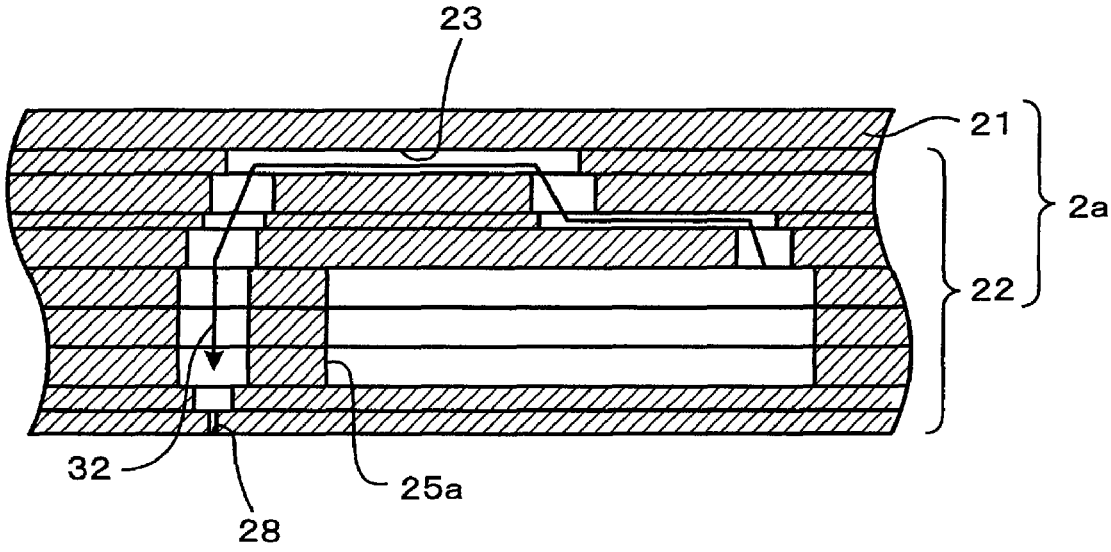
FIG. 3 is a partial sectional view of the ink-jet head.

As shown in FIGS. 2 and 3, the head main body 2*a* includes a passage unit 22 having a rectangular shape in a plan view and four actuator units 21 each having a trapezoidal shape. The passage unit 22 is formed of a total of nine plates layered on one another. The four actuator units 21 are arranged in a zigzag pattern on an upper face of the passage unit 22. In a lower face of the passage unit 22, many nozzle openings 28 are formed in a region corresponding to each actuator unit 21 so that the ink ejection face 2*b* is formed (see FIG. 1). Many pressure chambers 23 communicating with respective nozzles are formed in an upper face of the passage unit 22. The actuator units 21 are disposed so as to cover the pressure chambers 23. Formed inside the passage unit 22 are manifold channels 25, sub manifold channels 25*a*, and ink passages 32. The manifold channels 25 store therein ink which will be supplied to the pressure chambers 23. The sub manifold channels 25*a* branch from the manifold channels 25. The ink passages 32 are provided individually for the respective nozzles, and each of the ink passages 32 extends from the sub manifold channel 25*a* through a pressure chamber 23 to a nozzle opening 28, as shown in FIG. 3. Ink stored in an ink tank (not illustrated) is supplied to the manifold channel 25 via openings 25*b* that are formed on the upper face of the passage unit 22, and then distributed to the respective pressure chambers 23 via the sub manifold channels 25*a*. When the actuator unit 21 selectively applies pressure to a pressure chamber 23, ink contained in the pressure chamber 23 rises in pressure so that ink is ejected through a nozzle opening 28 that communicates with the pressure chamber 23.

As shown in FIG. 1, the ink ejection faces 2*b* of the four heads 2 are disposed along a horizontal direction. A belt conveyor mechanism 13 is disposed in such a manner that a surface of an upper part of a looped conveyor belt 8 confronts the ink ejection faces 2*b* with a narrow space being formed therebetween. The belt conveyor mechanism 13 includes the looped conveyor belt 8 that are wound around two rollers 6 and 7 to span the rollers 6 and 7. When one roller 6 rotates clockwise as indicated by an arrow X in FIG. 1, the conveyor belt 8 travels and the other roller 7 accordingly rotates. The belt conveyor mechanism 13 also includes a belt guide 51 that locates in a region enclosed with the conveyor belt 8. The belt guide 51 has a substantially rectangular parallelepiped shape and its width is almost equal to a width of the conveyor belt 8. The belt guide 51 supports the conveyor belt 8 while having its upper face in contact with a back face of the upper part of the looped conveyor belt 8.

Papers as record media are stacked in a paper feeder 11 (disposed at a left side in FIG. 1). The papers are, sequentially from an uppermost one, fed out onto the conveyor belt 8 of the belt conveyor mechanism 13 while being pinched by a pair of paper feed rollers 5*a* and 5*b*. The paper is kept on the surface of the upper part of the looped conveyor belt 8, and in this condition moves under the ink ejection faces 2*b* of the heads 2 along with traveling of the conveyor belt 8. At this time, ink of respective colors is ejected from the ink ejection faces 2*b*, so that a desired color image is formed on the paper. The paper having an image thus formed thereon is peeled off from the surface of the conveyor belt 8 by means of a peeling plate 10, and then fed to a paper discharger 12 disposed at a right side in FIG. 1.

The conveyor belt 8 has a two-layer structure made up of a polyester base impregnated with urethane, and a silicone rubber. The silicone rubber forms the surface of the conveyor belt 8. A press member 9*a* presses the paper, which has been conveyed by the paper feed rollers 5*a* and 5*b*, onto the surface of the conveyor belt 8. The paper is, while being kept on the surface of the conveyor belt 8 due to adhesive power, conveyed along with traveling of the conveyor belt 8. Also, a press member 9*b* is provided opposite to the press member 9*a* across the four heads 2, that is, on a downstream of the four heads 2 with respect to the paper conveyance direction.

Figure 4:
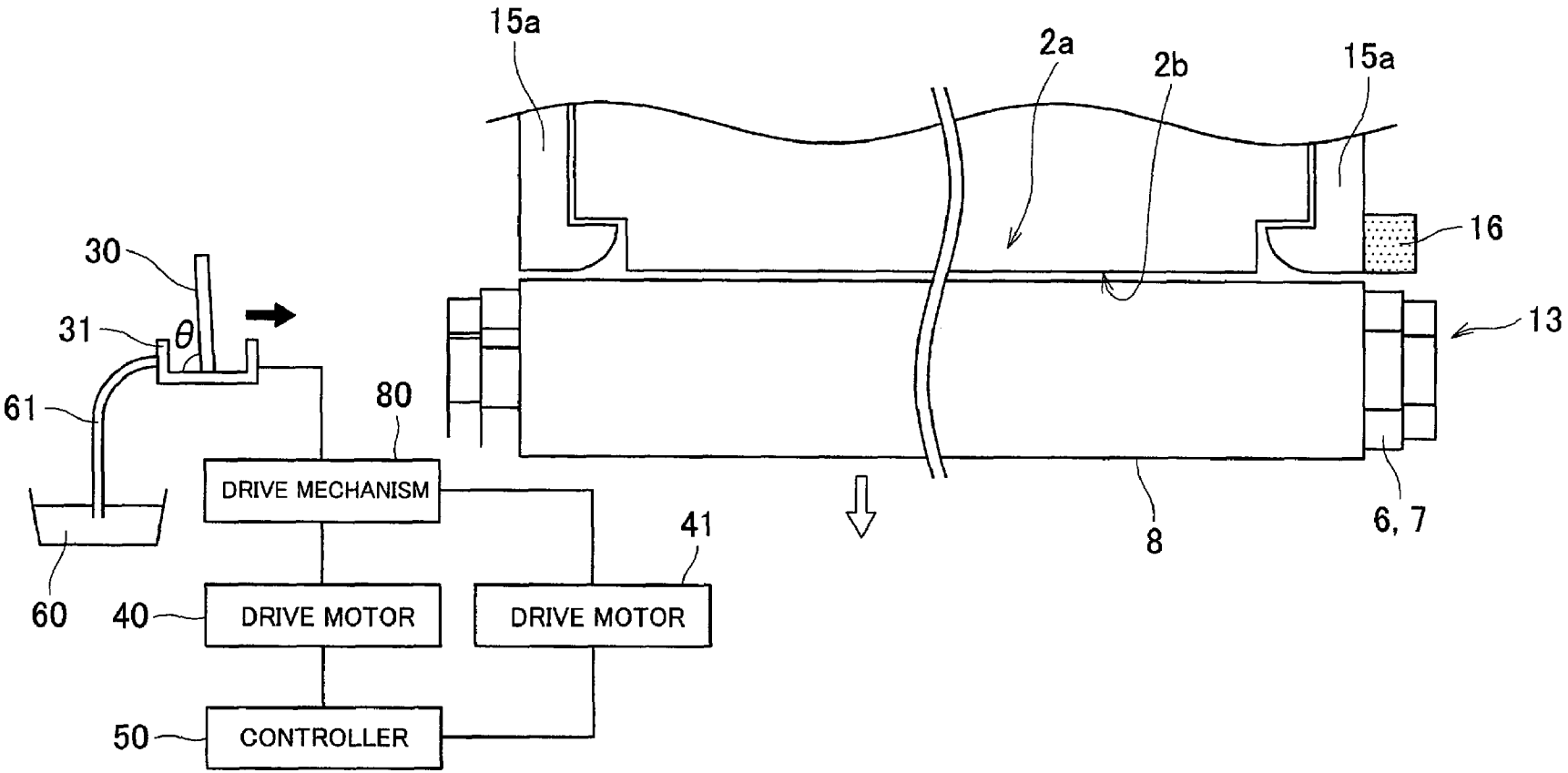
FIG. 4 is a side view of the ink-jet printer as seen from a left side in FIG. 1.

The four heads 2 are supported by a holder 15 so as to be fixed in position. As shown in FIG. 4, both ends of each head 2 with respect to a longitudinal direction of the head main body 2*a*, that is, with respect to the direction perpendicularly crossing the drawing sheet of FIG. 1, are cut out. Each cut-out portion is engaged with an L-shaped supporter 15*a* of the holder 15. Thus, the holder 15 supports, by means of a pair of L-shaped supporters 15*a*, one longitudinal end and the other longitudinal end of the ink ejection face 2*b* of the head main body 2*a* included in each head 2. Portions of the L-shaped supporters 15*a* adjoined to the one longitudinal end and the other longitudinal end of the ink ejection face 2*b* are rounded.

An ink absorber 16 capable of absorbing ink is provided on a side face of one of the pair of L-shaped supporters 15*a* of the holder 15 which is distant from a later-described stand-by position of a wiper 30. The ink absorber 16 may be made of a porous material such as urethane.

The belt conveyor mechanism 13 is, as shown in FIG. 1, supported by an elevator mechanism that includes a chassis 52 and a cylindrical member 53 capable of rotating on an eccentric shaft 54, so that the belt conveyor mechanism 13 can be moved up and down. The chassis 52 rotatably supports the rollers 6 and 7 of the belt conveyor mechanism 13, and is supported on a peripheral surface of the cylindrical member 53 which locates below the chassis 52. When the cylindrical member 53 rotates on the eccentric shaft 54, a top of the cylindrical member 53 is changed in level, and accordingly the chassis 52 is moved up and down along with the belt conveyor mechanism 13.

As shown in FIG. 4, the ink-jet printer 1 further includes the wiper 30 that wipes off ink adhering to the ink ejection faces 2*b*. FIG. 4 illustrates only one wiper 30, but the wiper 30 is provided for each of the four heads 2. Thus, a total of four wipers 30 are supported on a frame 31 and arranged side by side along a direction perpendicularly crossing the drawing sheet of FIG. 4 (see FIG. 5A). The wipers 30 are made of a flexible material such as urethane rubber. Each of the wipers 30 is a plate-like member having a width, which means its length with respect to the direction perpendicularly crossing the drawing sheet of FIG. 4, substantially equal to the width of the ink ejection face 2*b* of the head 2. Each wiper 30 is, at its lower end, fixed to a basal plane of the frame 31, and stands in such a manner that an acute angle θ is formed between the basal plane and a rear face of the wiper 30 with respect to a later-described wiping direction, which means, referring to FIG. 4, a face of the wiper 30 not confronting the head 2. By a movement mechanism 80 (see FIG. 5A) which will be described later, the frame 31 as well as the four wipers 30 is moved in a longitudinal direction of the ink ejection face 2*b* and in a vertical direction, i.e., a direction that is perpendicular to the ink ejection face 2*b*.

One end of a tube 61 is inserted through a side face of the frame 31. Thus, ink accumulated in the frame 31 as a result of a wiping operation is delivered via the tube 61 to a waste ink reservoir 60.

During a printing operation, as shown in FIG. 4, the belt conveyor mechanism 13 locates in a conveyance position which allows a surface of an upper part of the looped conveyor belt 8 to confront the ink ejection faces 2*b* of the heads 2 with a narrow space being formed therebetween, while the wipers 30 locate in a stand-by position which is, referring to FIG. 1, provided behind the belt conveyor mechanism 13.

When a wiping operation is performed, the belt conveyor mechanism 13 is, by the elevator mechanism, moved down from the conveyance position as indicated by a white arrow in FIG. 4 and stopped at a non-conveyance position. Here, the non-conveyance position means such a position that a space sufficient to prevent the wipers 30 and the frame 31 from being interrupted during a wiping operation appears between the ink ejection faces 2*b* and the surface of the upper part of the looped conveyor belt 8. After the belt conveyor mechanism 13 is moved down and stopped at the non-conveyance position, the wipers 30 together with the frame 31 moves from the stand-by position horizontally toward the heads 2 as indicated by a black arrow in FIG. 4. A wiping operation is performed, for example, when printing on a predetermined number of papers is completed.

Next, the drive mechanism 80 that drives the wipers 30 will be described with reference to FIGS. 5A to 5D, FIGS. 6A and 6B, and FIGS. 7A and 7B.

Figure 5A:
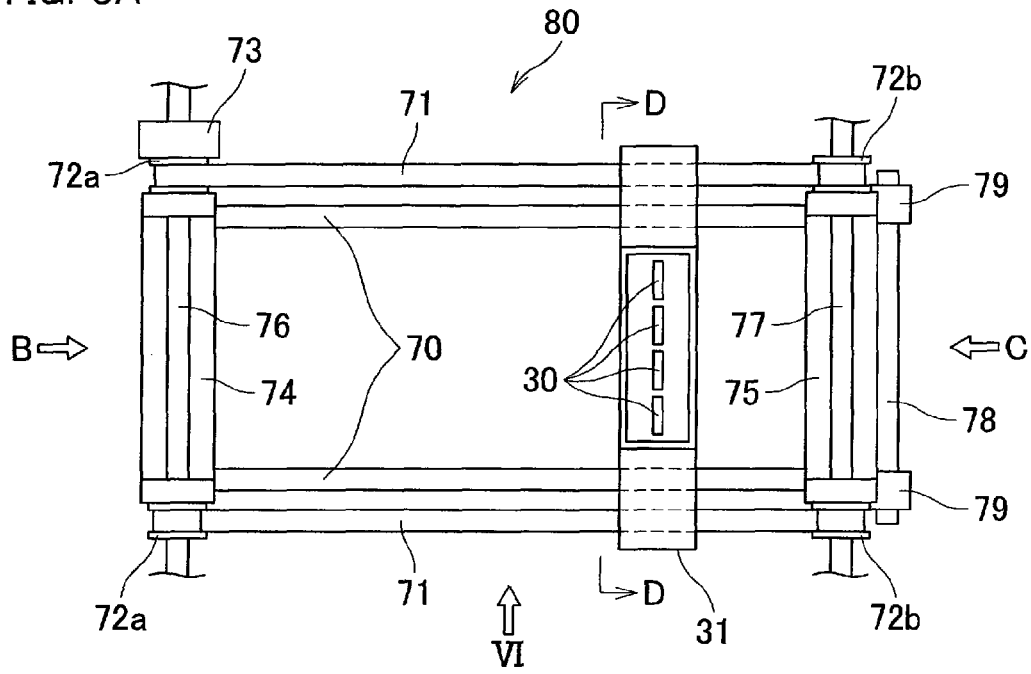
FIG. 5A is a plan view of a drive mechanism included in the ink-jet printer, which drives wipers.
Figure 5B:
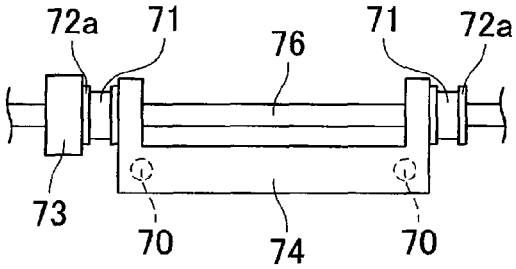
FIG. 5B is a side view of the drive mechanism as viewed in a direction B arrowed in FIG. 5A.
Figure 5C:
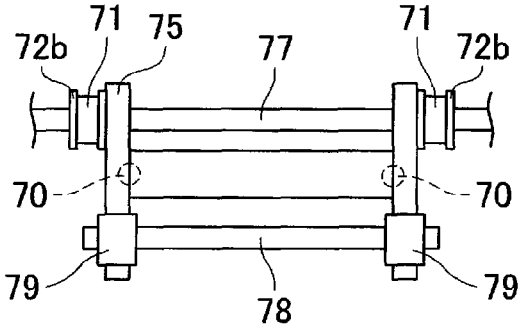
FIG. 5C is a side view of the drive mechanism as viewed in a direction C arrowed in FIG. 5A.

As shown in FIG. 5A, the drive mechanism 80 includes two guide bars 70 and two timing belts 71. The two guide bars 70 extend along the longitudinal direction of the head main body 2*a*, that is, along the direction perpendicularly crossing the drawing sheet of FIG. 1. The two timing belts 71 extend in parallel with the guide bars 70. In a plan view, the guide bars 70 are disposed on sides of the outermost head main bodies 2*a* so that the four head main bodies 2*a* are sandwiched between the guide bars 70. Each of the guide bars 70 has its both ends fixed to guide holders 74 and 75 (see FIGS. 5B and 5C). Shafts 76 and 77 are inserted through the guide holders 74 and 75, respectively, but the guide holders 74 and 75 do not rotate while the shafts 76 and 77 are rotating.

Figure 5D:
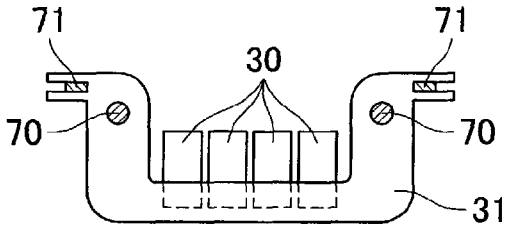
FIG. 5D is a sectional view as taken along a line D-D of FIG. 5A.

The shafts 76 and 77 extend perpendicularly to the guide bars 70 and the timing belts 71. Both ends of the respective shafts 76 and 77 are rotatably supported on a main body of the printer 1. A pair of pulleys 72*a* and a pair of pulleys 72*b* are fixed to portions adjacent to both ends of the shaft 76 and the shaft 77, respectively. Each of the timing belts 71 is an endless belt, and wound around the pulleys 72*a* and 72*b* so as to be stretched between the pulleys 72*a* and 72*b* that are opposed to each other with respect to a lateral direction of FIG. 5A. As shown in FIG. 5D, the frame 31 supporting the wipers 30 is fixed to the timing belts 71 and slidably supported on the guide bars 70.

A scanning gear 73 is fixed to the shaft 76. When the drive motor 40 is driven under control by the controller 50 (see FIG. 4), the scanning gear 73 is rotated in one direction and a reverse direction. Along with rotation of the scanning gear 73, the shaft 76 and the pulleys 72*a* are rotated together. That is, the scanning gear 73, the shaft 76, and the pulleys 72*a* are rotated concurrently, because they are fixed to one another. Thus, the timing belts 71 wound around the pulleys 72*a* travel accordingly. Along with the traveling of the timing belts 71, the pulleys 72*b* as well as the shaft 77 are rotated. Along with the traveling of the timing belt 71, the frame 31 moves in the lateral direction of FIG. 5A, that is, in the longitudinal direction of the ink ejection face 2*b*.

Figure 7A:
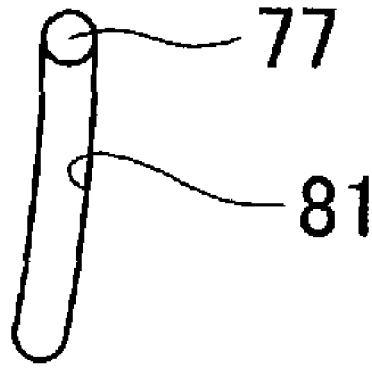
FIGS. 7A and 7B are schematic views showing a position of a shaft of the drive mechanism which is in a state of FIG. 6A and a state of FIG. 6B, respectively.
Figure 7B:
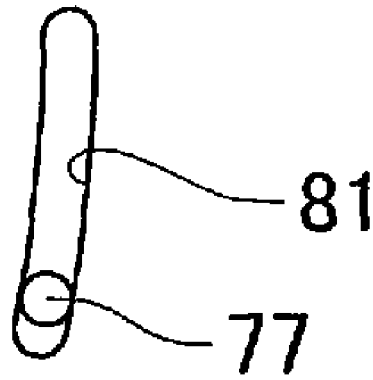

Both ends of the shaft 77 are inserted into grooves 81 that are formed in the main body of the printer 1 (see FIGS. 7A and 7B). As the both ends of the shaft 77 moves within the groove 81, the shaft 77 swings. The groove 81 has a shape of circular arc centered about the shaft 76.

Figure 6A:
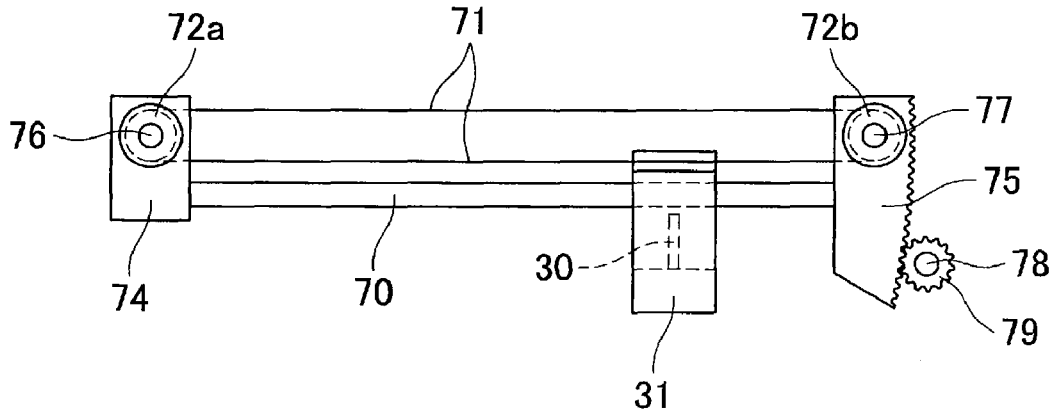
FIGS. 6A and 6B are side views of the drive mechanism as viewed in a direction VI arrowed in FIG. 5A.
Figure 6B:
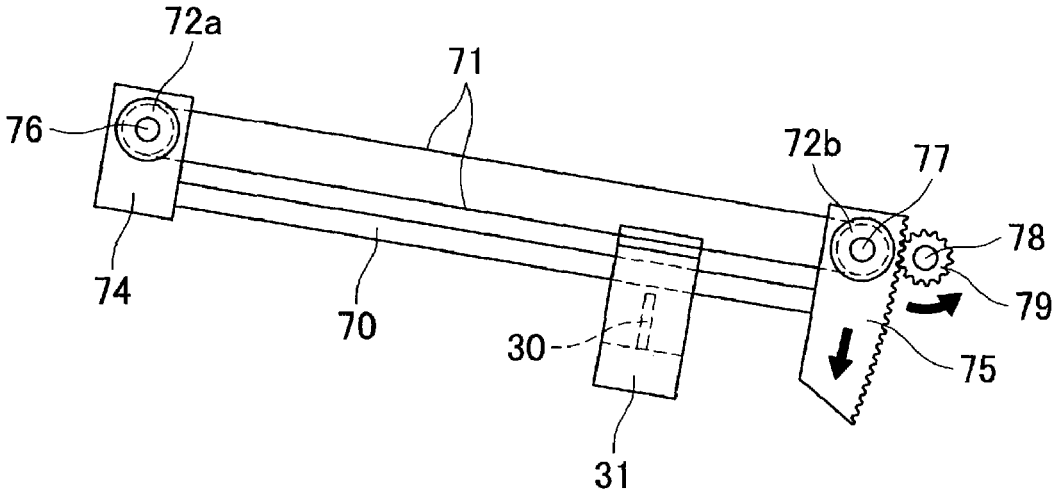

As shown in FIGS. 6A and 6B, one end face of the guide bar holder 75 has a shape of circular arc centered about the shaft 76. Teeth engageable with the gear 79 are formed in the one end face. The gear 79 rotates on the shaft 78, together with the shaft 78 that is rotatably mounted on the main body of the printer 1. When a drive motor 41 is driven under control by the controller 50 (see FIG. 4), the shaft 78 is rotated in one direction and a reverse direction. The gear 79 is rotated accordingly, so that the guide bar holder 75 which is engaged with teeth of the gear 79 swings together with the shaft 77.

For example when, in a state shown in FIG. 6A, the gear 79 is rotated counterclockwise, the guide bar holder 75 swings down together with the shaft 77 as shown in FIG. 6B. FIGS. 7A and 7B show a position of the shaft 77 relative to the groove 81, in states shown in FIGS. 6A and 6B,. respectively.

Like this, the frame 31 is movable in the lateral direction of FIG. 5A, that is, in the longitudinal direction of the ink ejection face 2*b* along with traveling of the timing belt 71, and besides movable in the direction perpendicularly crossing the drawing sheet of FIG. 5A, that is, in the direction perpendicular to the ink ejection face 2*b* along with swinging of the shaft 77 and the guide bar holder 75.

Next, an operation of the wiper 30 during a wiping operation will be described. An operation of the wiper 30 which will be described below is controlled by the controller 50 illustrated in FIG. 4, and implemented by the above-described drive mechanism 80.

First, along the black arrow in FIG. 4, the wiper 30 moves from the stand-by position horizontally in a longitudinal direction of the head 2. A direction of this movement will be referred to as a wiping direction. A face of the plate-like wiper 30 facing frontward with respect to the wiping direction will be referred to as a front face, and an opposite face of the wiper 30 will be referred to as a rear face. A top of the wiper 30 is, when its front face comes into contact with a corner of the L-shaped supporter 15*a* of the holder 15 closer to the stand-by position of the wiper 30, i.e., a corner of the left L-shaped supporter 15*a* in FIG. 4, bent toward a direction reverse to the wiping direction. The wiper 30 moves in the wiping direction with its top being bent in this manner.

Figure 8A:
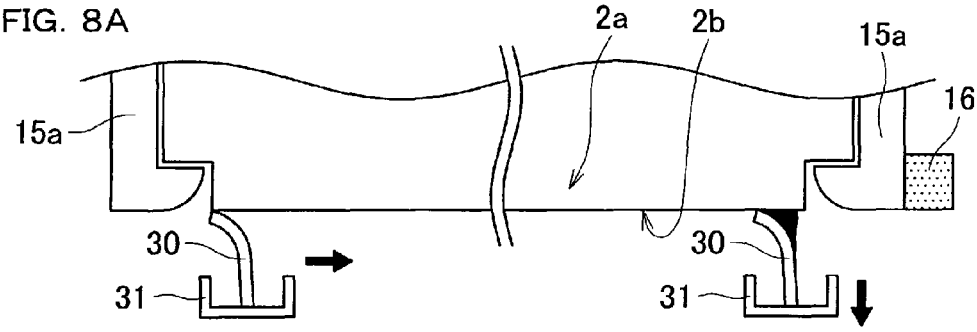
FIGS. 8A, 8B, 8C, and 8D are views that explain how a wiper operates during a wiping operation.

Then, as shown in FIG. 8A, a top of the wiper 30 reaches one longitudinal end of the ink ejection face 2*b* of the head main body 2*a*, i.e., the left end of the ink ejection face 2*b* in FIG. 8A, and further moves in the wiping direction with its top being bent, which is referred to as a wiping operation. Along with the wiping operation, ink adhering to the ink ejection face 2*b* is wiped off from the ink ejection face 2*b*, and held between the ink ejection face 2*b* and the front face of the top of the wiper 30 which is being bent.

When the top of the wiper 30 reaches a wiping termination position which comes before the other longitudinal end of the ink ejection face 2*b*, i.e., the right end of the ink ejection face 2*b* in FIG. 8A, to be more specific, when the top of the wiper 30 reaches a position between the other longitudinal end of the ink ejection face 2*b* and a nozzle opening 28 (see FIG. 3) nearest to the other longitudinal end, the wiper 30 is stopped at that position for a few seconds with its top being bent and kept in contact with the ink ejection face 2*b*. While the wiper 30 is thus stopped, the ink held between the ink ejection face 2*b* and the front face of the top of the wiper 30 which is being bent gradually streams down the wiper 30.

After a few seconds elapse, the wiper 30 moves down together with the frame 31, and becomes spaced apart from the ink ejection face 2*b* to elastically recover. At this time, among the ink that has been held between the ink ejection face 2*b* and the front face of the top of the wiper 30 which is being bent, a very small amount of ink remains on the ink ejection face 2*b* while most of the ink is carried on the wiper 30 and gradually streams down the front and rear faces of the wiper 30. The ink reaches a bottom of the wiper 30 and is accumulated within the frame 31, and then delivered to the waste ink reservoir 60 via the tube 61 illustrated in FIG. 4.

Figure 8B:
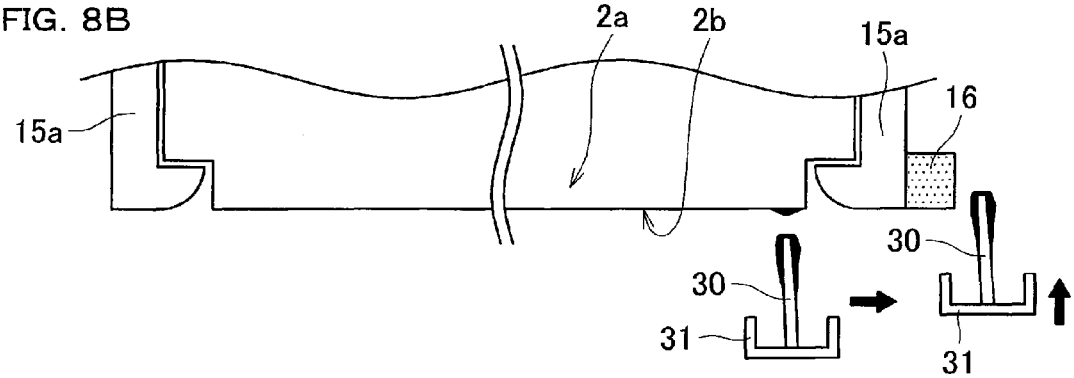
Figure 8C:
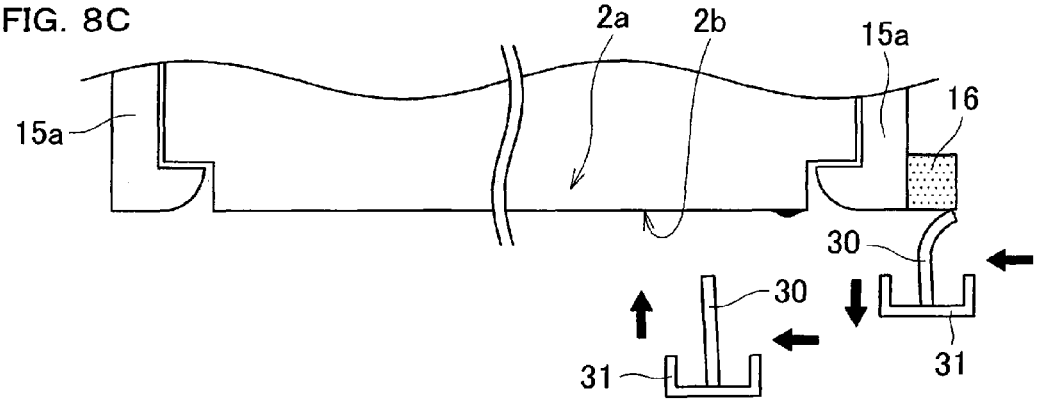

Then, as shown in FIG. 8B, the wiper 30 moves in the wiping direction while being spaced apart from the ink ejection face 2*b*. The wiper 30 stops at a position beyond the ink absorber 16 with respect to the horizontal direction. Then, the wiper 30 moves up, and stops at such a position that a tip end of the wiper 30 comes higher than a lower face of the ink absorber 16, to be more specific, such a position that the wiper 30 locates a little higher than the position it takes in the wiping operation with respect to the vertical direction. Subsequently, as shown in FIG. 8C, the wiper 30 moves in the direction reverse to the wiping direction, and a rear face of the top of the wiper 30 comes into contact with the ink absorber 16 so that the top is bent toward the wiping direction. A degree of bending of the wiper 30 at this time is larger than that in the wiping operation, because the wiper 30 locates, with respect to the vertical direction, a little higher than in the wiping operation as described above. Since, like this, the rear face of the wiper 30 is brought into contact with the ink absorber 16, ink adhering to the rear face of the wiper 30 is absorbed into the ink absorber 16, so that ink is no longer adhered to the rear face of the wiper 30.

When the top of the wiper 30 then reaches the right L-shaped supporter 15*a* of the holder 15 in FIG. 8C, the wiper 30 stops. Then, the wiper 30 moves down, and becomes spaced apart from the L-shaped supporter 15*a*, to elastically recover. The wiper 30 then moves in the direction reverse to the wiping direction while being spaced apart from the right L-shape supporter 15*a* and the ink ejection face 2*b*. The wiper 30 stops when, with respect to the horizontal direction, the top of the wiper 30 slightly passes the wiping termination position. Then, the wiper 30 moves up to a position that is, with respect to the vertical direction, a little lower than the position it takes during the wiping operation as shown in FIG. 8A (see FIG. 8C).

Figure 8D:
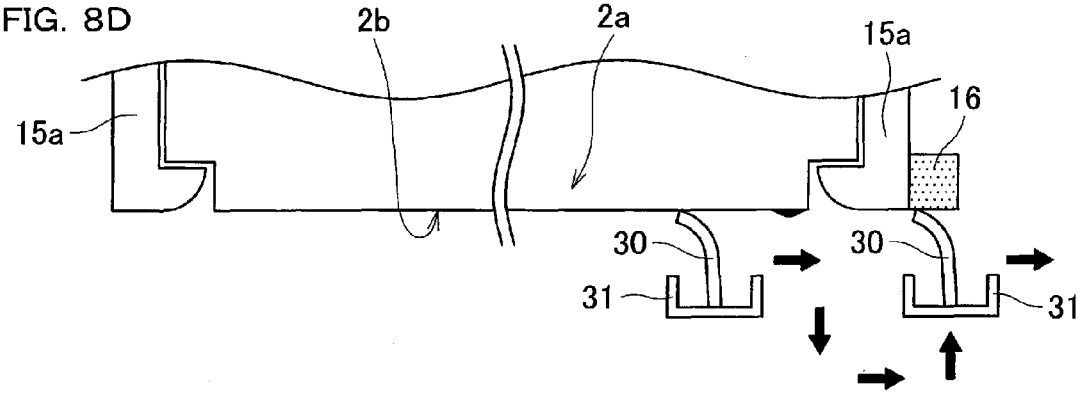

As shown in FIG. 8D, the top of the wiper 30 comes into contact with the ink ejection face 2*b* again, and is bent toward the direction reverse to the wiping direction. In this condition, the wiper 30 moves in the wiping direction. This operation will be referred to as a rewiping operation. In this rewiping operation, the wiper 30 moves at a speed lower than in the wiping operation shown in FIG. 8A. A degree of bending of the wiper 30 at this time is smaller than that in the wiping operation, because, as described above, the wiper 30 locates a little lower than in the wiping operation with respect to the vertical direction. In the rewiping operation, the wiper 30 stops immediately before the other longitudinal end of the ink ejection face 2*b*, and moves down to become spaced apart from the ink ejection face 2*b*. Then, the wiper 30 moves in the wiping direction until its top comes under the ink absorber 16.

When the top of the wiper 30 comes under the ink absorber 16, the wiper 30 stops and then moves up therefrom toward the ink absorber 16. Thus, the front face of the top of the wiper 30 comes into contact with the ink absorber 16, and the top is bent toward the direction reverse to the wiping direction. In this condition, as shown in FIG. 8D, the wiper 30 moves in the wiping direction beyond the ink absorber 16, to elastically recover. Along with this movement, ink adhering to the front face of the wiper 30 is absorbed into the ink absorber 16, so that ink is no longer adhered to the front face of the wiper 30.

In this embodiment, as thus far described above, when the wiper 30 becomes spaced apart from the ink ejection face 2*b*, most of ink which has been gathered in the wiping operation is, without entering between the L-shaped supporter 15*a* and the other longitudinal end of the ink ejection face 2*b*, kept on the wiper 30 and moved away from the ink ejection face 2*b* along with the wiper 30, as shown in FIG. 8B. Thus, little ink is left on the head 2. This can relieve a problem that inside of the printer 1 is polluted with ink as a result of the wiping operation.

The head 2 is relatively long, to be more specific, its length is equal to or larger than a width of a paper as a record medium. Accordingly, while the wiper 30 moves along the longitudinal direction of the head 2 in the wiping operation as shown in FIG. 8A, the wiper 30 gathers a large amount of ink. Even in this case, since the wiper 30 becomes spaced apart from the ink ejection face 2*b* at a point between the other longitudinal end of the ink ejection face 2*b* and the nozzle opening 28 nearest to the other longitudinal end, there can be relieved the aforementioned problem that inside of the printer 1 is polluted with ink. This problem may otherwise be caused by, for example, ink scattered at the time when the wiper 30 elastically recovers at a point beyond the other longitudinal end of the ink ejection face 2*b*.

A water-repellent treatment is given to a whole area of the ink ejection face 2*b*, and the other region of the head main body 2*a* is not given a water-repellent treatment. Accordingly, ink adhesivity is low in the whole area of the ink ejection face 2*b*, while it is high in the other region. Therefore, at the other longitudinal end of the ink ejection face 2*b*, to be more specific, at a boundary between the ink ejection face 2*b* and a side face of the head main body 2*a* confronting a tip of the L-shaped supporter 15*a*, ink adhesivity changes to become larger. That is, in this embodiment, the other longitudinal end of the ink ejection face 2*b* corresponds to a "changing position at which ink adhesivity changes to become larger" of the present invention. In such a case, if, in the wiping operation, the wiper 30 moves to the other longitudinal end of the ink ejection face 2*b*, ink can easily enter a gap between the head 2 and the L-shaped supporter 15*a* of the holder 15. In this embodiment, however, the wiper 30 becomes spaced apart from the ink ejection face 2*b* before it reaches the other longitudinal end of the ink ejection face 2*b*. This can efficiently prevent ink from entering the gap between the head 2 and the holder 15.

The whole area of the ink ejection face 2*b* is given a water-repellent treatment, and the wiper 30 becomes spaced apart from the ink ejection face 2*b* at a point within the water-repellent region. Accordingly, ink gathered in the wiping operation smoothly transfers to the wiper 30 and little ink is left on the ink ejection face 2*b*. As a result, the problem that inside of the printer 1 is polluted with ink can more surely be relieved.

The holder 15 has a pair of L-shaped supporters 15*a* that respectively support one longitudinal end and the other longitudinal end of the ink ejection face 2*b* of each head 2. The L-shaped supporter 15*a* that supports the other longitudinal end of the ink ejection face 2*b* is, at its portion adjoined to the other longitudinal end of the ink ejection face 2*b*, rounded. If this portion of the holder 15 is not rounded but angulated for example, a gap between the head 2 and this portion of the holder 15 becomes very small and therefore ink may more easily enter the gap due to capillarity. However, since the portion of the holder is rounded, the gap is enlarged to effectively restrain ink from entering the gap between the head 2 and the holder 15.

Immediately before the wiper 30 becomes spaced apart from the ink ejection face 2*b* as shown in FIG. 8B, the wiper 30 is stopped for a few seconds while being kept in contact with the ink ejection face 2*b*. Consequently, most of ink gathered in the wiping operation transfers from the ink ejection face 2*b* to the wiper 30, and little ink is left on the ink ejection face 2*b*. This can more effectively prevent inside of the printer 1 from being polluted with ink.

The ink absorber 16 is provided to the printer 1. As shown in FIG. 8C, the wiper 30 spaced apart from the ink ejection face 2*b* is brought into contact with the ink absorber 16 so that ink adhering to the wiper 30 is absorbed into the ink absorber 16. The ink adhering to the wiper 30 can thereby be removed.

After the wiping operation, ink adhering to the wiper 30 is removed by means of the ink absorber 16, and then a rewiping operation is further performed as shown in FIG. 8D. That is, the ink ejection face 2*b* is wiped again. As a result, a little ink that was left after the first wiping operation can be removed.

At the time when the wiper 30 becomes spaced apart from the ink ejection face 2*b* as shown in FIG. 8B, ink may often adhere to the rear face of the wiper 30. If the wiper 30 in this condition is brought into contact with the ink ejection face 2*b* again, the ink adhering to the rear face of the wiper 30 may undesirably adhere to the ink ejection face 2*b*. However, this problem can be suppressed, because, before a rewiping is performed, the ink adhering to the rear face of the wiper 30 is removed by the ink absorber 16 as shown in FIG. 8C.

In the rewiping operation, the wiper 30 moves in the wiping direction at a speed lower than in the first wiping operation. Accordingly, even if the wiper 30 reaches the other longitudinal end of the ink ejection face 2*b* during the rewiping operation, ink gathered by the wiper 30 cannot easily scatter or enter the gap between the head 2 and the holder 15.

After the first wiping operation is completed, the rewiping operation is performed. Then, ink adhering to the wiper 30 is absorbed into the ink absorber 16 and thus removed, as shown in FIG. 8D. Therefore, a next wiping operation can be performed with the wiper 30 to which almost no ink adheres.

The ink absorber 16 is held on the L-shaped supporter 15*a* of the holder 15 that supports the other longitudinal end of the ink ejection face 2*b*, i.e., the right end in FIG. 4. This allows the ink absorber 16 to be provided near the ink ejection face 2*b*. Accordingly, the movement of the wiper 30, which is needed at the time when the ink absorber 16 removes ink from the wiper 30 as shown in FIGS. 8C and 8D, can be performed efficiently in a short time.

The wiper 30 has flexibility, and a degree of bending of the wiper 30 is adjusted by changing a position of the wiper 30 with respect to the vertical direction. By adjusting the degree of bending of the wiper 30 to a degree suitable for a purpose, the wiping operation, the rewiping operation, removal of ink from the wiper 30 using the ink absorber 16, etc. can be performed efficiently. More specifically, the degree of bending of the wiper 30 in the rewiping operation is smaller than that in the wiping operation. This can effectively restrain ink from scattering at the time when the rewiping is completed and the wiper elastically recovers. In addition, the degree of bending of the wiper 30 at the time when the ink absorber 16 absorbs ink is larger than that in the wiping operation. Accordingly, ink can efficiently be removed from the wiper 30, to allow ink left on the ink ejection face 2*b* to be more surely removed in the subsequent rewiping operation.

Next, modifications of the ink absorber according to the present invention will be described with reference to FIGS. 9 and 10.

Figure 9:
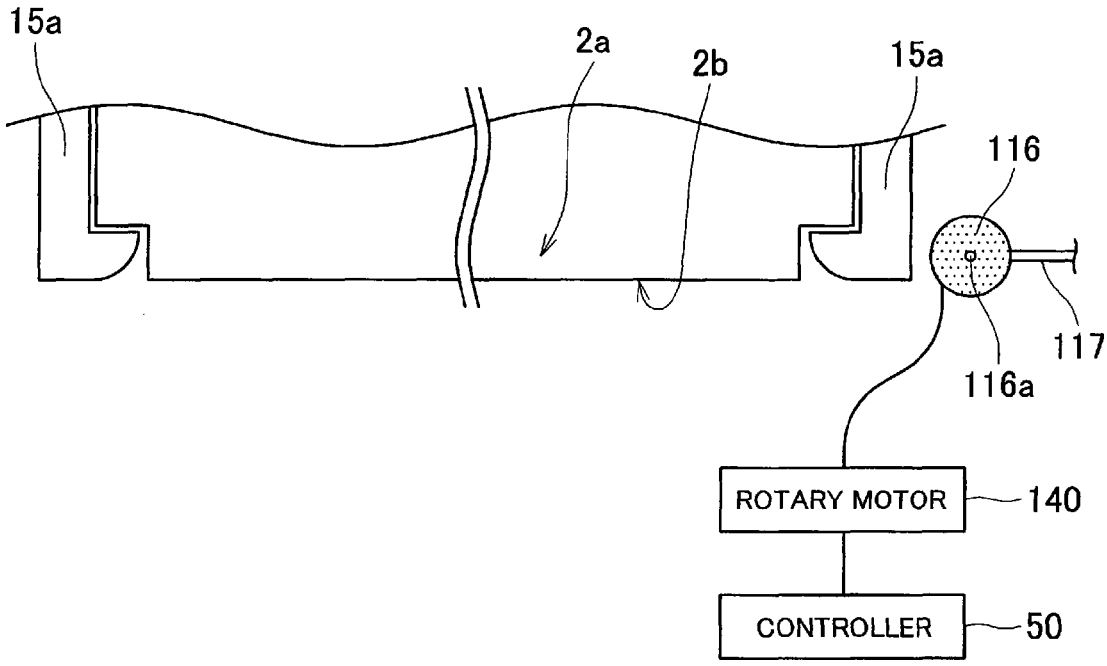
FIG. 9 schematically illustrates a first modification of an ink absorber.

In the first modification shown in FIG. 9, an ink absorber 116 having a cylindrical shape unlike the ink absorber 16 of the above-described embodiment is adopted. The ink absorber 116 is not held on the L-shaped supporter 15*a* of the holder 15 that supports the other longitudinal end of the ink ejection face 2*b*, but disposed on a side of the L-shaped supporter 15*a* with a narrow gap being formed therebetween. The ink absorber 116 is connected to a rotary motor 140, and rotates on a central axis 116*a* when the rotary motor 140 is driven. The rotary motor 140 is connected to the controller 50. For example, after the wiping operation is performed several times, the controller 50 drives the rotary motor 140 so as to make the ink absorber 116 rotate on the central axis 116*a*. Thereby, a scraper 117, which is disposed in such a manner that its tip end can be in contact with a peripheral surface of the ink absorber 116, scrapes ink out of the ink absorber 116.

In the same manner as shown in FIGS. 8C and 8D, the top of the wiper 30 comes into contact with the ink absorber 116, so that ink is held within the ink absorber 116. The ink absorber 116 can usually hold only a limited amount of ink. Besides, if the ink absorber 116 holds a certain amount of ink, its absorption capacity may deteriorate. Therefore, in this modification, ink existing within the ink absorber 116 is scraped out by the scraper 117, so that an ink absorption capacity of the ink absorber 116 is maintained in a good condition.

Figure 10:
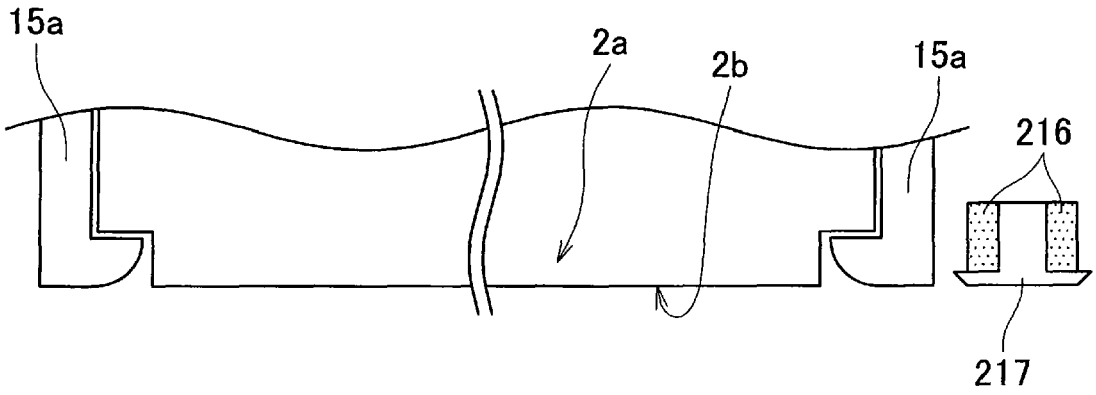
FIG. 10 schematically illustrates a second modification of the ink absorber.

In a second modification shown in FIG. 10, an ink absorber 216 is held on a scraper 217. The ink absorber 216 and the scraper 217 are, like the modification shown in FIG. 6, not held on the L-shaped supporter 15*a* of the holder 15 that supports the other longitudinal end of the ink ejection face 2*b*, but disposed on a side of the L-shaped supporter 15*a* with a narrow gap being formed therebetween. The scraper 217 has an inverted-T shape made up of a shaft and a base. The shaft holds the ink absorber 216 on its both sides. Both ends of the base are sharpened upward. The sharpened ends of the scraper 217 do not serve to hold the ink absorber 216, and are exposed.

In this modification, in order to remove ink adhering to the wiper 30, the front face or the rear face of the wiper 30 is brought into contact with the sharpened end of the scraper 217, to thereby bend the top of the wiper 30. In a case where, for example, ink adhering to the wiper 30 is absorbed into the ink absorber 216 after the first wiping operation as shown in FIG. 8C, the rear face of the wiper 30 is brought into contact with the right end of the base of the scraper 217 in FIG. 10. Alternatively, after the rewiping operation as shown in FIG. 8D, the front face of the wiper 30 is brought into contact with the left end of the base of the scraper 217 in FIG. 10. As the wiper 30 is moved scrapingly while in contact with the end of the scraper 217, ink adhering to the wiper 30 is removed by the scraper 217, moved to an upper face of the base of the scraper 217, and then absorbed into the ink absorber 217.

In the modification shown in FIG. 10, deterioration of the ink absorber 216 due to friction, etc. can be prevented, and moreover ink, dust, or the like that adhere to the ink absorber 216 can be prevented from adhering to the wiper 30.

A point at which the wiper 30, after the first wiping operation, becomes spaced apart from the ink ejection face 2*b* is not limited to the point between the other longitudinal end of the ink ejection face 2*b* and the nozzle opening 28 nearest to the other longitudinal end as in the above-described embodiment. In the above-described embodiment, the other longitudinal end of the ink ejection face 2*b* corresponds to a "changing position at which ink adhesivity changes to become larger" of the present invention. In a case where, for example, the water-repellent treatment is omitted in a region near the other longitudinal end of the ink ejection face 2*b*, a non-water-repellent region where ink adhesivity is relatively high appears as a result of the omission of the water-repellent treatment. In this case, a boundary between the water-repellent region and the non-water-repellent region corresponds to the "changing position", and thus a point at which, after the first wiping operation is completed, the wiper 30 becomes spaced apart from the ink ejection face 2*b* may locate within a part of the water-repellent region which is between the nozzle opening 28 nearest to the other longitudinal end and a boundary with the non-water-repellent region. Like this, the "changing position at which ink adhesivity changes to become larger" may be determined in accordance with various elements. Then, based on the "changing position", a point at which, after the first wiping operation is completed, the wiper 30 becomes spaced apart from the ink ejection face 2*b* is determined.

In the above-described embodiment, the head 2 is fixed and the wiper 30 is moved relative to the head 2. However, it may also be possible that the wiper 30 is fixed and the head 2 is moved relative to the wiper 30, as long as a relative positional relationship of the wiper 30 to the head 2 is changed.

In the above-described embodiment, the wiper 30 is provided in one-to-one correspondence with each head 2. However, two or more wipers 30 may be provided for each head 2, or alternatively one common wiper 30 may be provided for the four heads 2. In addition, a shape of the wiper 30 is not limited to a plate-like shape.

To perform the wiping operation, the wiper 30 may move along, instead of the longitudinal direction of the head 2, a widthwise direction of the head 2.

Such a portion of the L-shaped supporter 15*a* of the holder 15 that is adjoined to the other longitudinal end of the ink ejection face 2*b* may not necessarily be rounded, but may be oblique with respect to the ink ejection face 2*b* for example.

One ink absorber 16, 116, 216 may be provided for each head 2, i.e., for each wiper 30. Alternatively, one ink absorber 16, 116, 216 may be provided for the four heads 2, i.e., for the four wipers 30. The ink absorber 16, 116, 216 may be made of various materials except urethane, as long as the ink absorber 16, 116, 216 is capable of absorbing ink. A shape of the ink absorber 16, 116, 216 is also not limited to the one employed in the above-described embodiment and modifications, and may take various shapes. The ink absorber 16, 116, 216 may not necessarily be held on the L-shaped supporter 15*a* of the holder 15 that supports the other longitudinal end of the ink ejection face 2*b*, nor disposed on the side of the L-shaped supporter 15*a* to neighbor it. The ink absorber 16, 116, 216 may be disposed at various positions within the printer 1.

The ink absorber 16, 116, 216 may be omitted. In this case, the operation by which ink adhering to the wiper 30 is absorbed into the ink absorber 16, 116, 216 (see FIGS. 8C and 8D) is not performed.

The operation by which ink adhering to the rear face of the wiper 30 is absorbed into the ink absorber 16, 116, 216 before the rewiping operation, the operation by which ink adhering to the wiper 30 is absorbed into the ink absorber 16, 116, 216 after the rewiping operation, or the like, may be omitted.

The degree of bending of the wiper 30 may not necessarily be changed, but it may be controlled at a constant degree.

It may not always be necessary that in the rewiping operation the wiper 30 moves in the wiping direction at a speed lower than in the first wiping operation. The speed of movement may be constant, for example.

The present invention can be applied not only to line-type printers, but also to serial-type printers. In addition, the present invention can also be applied to recording apparatuses such as facsimile machines, copying machines, etc. as well as printers.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

an ink-jet head having an ink ejection face on which a plurality of nozzle openings that eject ink are formed, the ink ejection face having a changing position at which ink adhesivity changes to become larger along a wiping direction oriented from one end to the other end of the ink ejection face, and the changing position being positioned between the other end and a nozzle opening nearest to the other end;

a wiper that wipes off ink adhering to the ink ejection face;

a drive mechanism that drives at least either one of the ink-jet head and the wiper such that the wiper moves in the wiping direction relative to the ink-jet head and such that the wiper becomes spaced apart from the ink ejection face; and a wiping controller that controls the drive mechanism such that the wiper, while keeping in contact with the ink ejection face, moves relative to the ink-jet head in the wiping direction, and also such that the wiper becomes spaced apart from the ink ejection face at a point between the nozzle opening nearest to the other end and the changing position.

2. The ink-jet recording apparatus according to claim 1, wherein:

the ink-ejection face is given a water-repellent treatment; and the wiping controller controls the wiper such that the wiper becomes spaced apart from the ink ejection face within a region that is given the water-repellent treatment.

3. The ink-jet recording apparatus according to claim 1, wherein:

a length of the ink-jet head is equal to or larger than a width of a record medium; and the wiping controller controls the drive mechanism such that the wiper moves relatively along a longitudinal direction of the ink-jet head.

4. The ink-jet recording apparatus according to claim 1, further comprising a holder that holds the ink-jet head by supporting the one end and the other end of the ink ejection face of the ink-jet head, wherein the changing position is the other end of the ink ejection face.

5. The ink-jet recording apparatus according to claim 4, wherein:

the holder includes a one-end supporter that supports the one end of the ink ejection face of the ink-jet head, and an other-end supporter that supports the other end of the ink ejection face of the ink-jet head; and a portion of the other-end supporter adjoined to the other end of the ink ejection face is rounded.

6. The ink-jet recording apparatus according to claim 1, wherein the wiping controller controls the drive mechanism such that, immediately before the wiper becomes spaced apart from the ink ejection face, the wiper stops for a predetermined period of time while kept in contact with the ink ejection face.

7. The ink-jet recording apparatus according to claim 1, wherein a first drive source and a second drive source are provided separately, the first drive source giving driving force to the drive mechanism such that the wiper moves relative to the ink-jet head in the wiping direction, the second drive source giving driving force to the drive mechanism such that the wiper moves in a direction crossing the ink ejection face.

8. The ink-jet recording apparatus according to claim 7, wherein:

the drive mechanism includes a slide mechanism that moves the wiper in the wiping direction, and a gear mechanism that moves the wiper in the direction crossing the ink ejection face;

the slide mechanism includes a wiper holder that holds the wiper, a guide that supports the wiper holder slidably in the wiping direction, first and second shafts that are disposed at a distance with respect to the wiping direction to sandwich the ink-jet head therebetween, pulleys that are fixed respectively to the first and second shafts, and an endless belt that is wound around and stretched between the pulleys and has the wiper holder fixed thereto, such that, when the first shaft is rotated by driving force of the first drive source, one of the pulleys fixed to the first shaft is rotated and thus the belt travels to thereby make the wiper holder which is supported on the guide slide in the wiping direction; and the gear mechanism includes a first gear that is rotatably mounted to the second shaft and has the guide fixed thereto, and a second gear, the first gear having an end face of arc shape centered about the first shaft, the second gear being engaged with the end face, such that, when the second gear is rotated by driving force of the second drive source, the second shaft and the first gear move in an arc about the first shaft to thereby make the wiper holder which is supported on the guide move in the direction crossing the ink ejection face.

9. The ink-jet recording apparatus according to claim 1, further comprising an ink absorber, wherein the wiping controller controls the drive mechanism such that the ink absorber absorbs ink adhering to the wiper that has been spaced apart from the ink ejection face.

10. The ink-jet recording apparatus according to claim 9, wherein the ink absorber is held on an end of a holder holding the ink-jet head, the end supporting the other end of the ink ejection face.

11. The ink-jet recording apparatus according to claim 9, wherein the ink absorber has a cylindrical shape, and wherein the ink-jet recording apparatus further comprises:

a rotary drive mechanism that makes the ink absorber rotate on a central axis;

a scraper having its end brought into contact with a peripheral surface of the ink absorber; and an absorber-rotation controller that controls the rotary drive mechanism to make the ink absorber rotate.

12. The ink-jet recording apparatus according to claim 9, further comprising a scraper that holds the ink absorber, wherein:

an end of the scraper is exposed; and the wiping controller controls the drive mechanism to bring the wiper into contact with the end of the scraper such that ink adhering to the wiper is absorbed by the ink absorber via the scraper.

13. The ink-jet recording apparatus according to claim 9, wherein the wiping controller controls the drive mechanism such that, after the ink absorber absorbs ink adhering to the wiper, the wiper relatively moves, while kept in contact with the ink ejection face, in the wiping direction from a vicinity of the point at which the wiper has been spaced apart from the ink ejection face.

14. The ink-jet recording apparatus according to claim 13, wherein the wiping controller controls the drive mechanism such that, after the wiper becomes spaced apart from the ink ejection face and before the wiper comes into contact with the ink ejection face again, the ink absorber absorbs ink adhering to a rear face of the wiper with respect to the wiping direction.

15. The ink-jet recording apparatus according to claim 13, wherein the wiping controller controls the drive mechanism such that, after the wiper once spaced apart from the ink ejection face comes into contact with the ink ejection face again, the wiper moves in the wiping direction at a speed lower than before the wiper becomes spaced apart from the ink ejection face.

16. The ink-jet recording apparatus according to claim 13, wherein the wiping controller controls the drive mechanism such that, after the wiper once spaced apart from the ink ejection face comes into contact with the ink ejection face again to then relatively move in the wiping direction, the ink absorber absorbs ink adhering to the wiper.

17. The ink-jet recording apparatus according to claim 13, wherein:

the wiper has flexibility; and the wiping controller controls the drive mechanism to change a degree of bending of the wiper.

18. The ink-jet recording apparatus according to claim 17, wherein the wiping controller controls the drive mechanism such that a degree of bending of the wiper at the time when the wiper once spaced apart from the ink ejection face comes into contact with the ink ejection face again is smaller than a degree of bending of the wiper at the time before the wiper becomes spaced apart from the ink ejection face.

19. The ink-jet recording apparatus according to claim 17, wherein the wiping controller controls the drive mechanism such that a degree of bending of the wiper at the time when the ink absorber absorbs ink adhering to the wiper spaced apart from the ink ejection face is larger than a degree of bending of the wiper at the time before the wiper becomes spaced apart from the ink ejection face.

* * * * *